US008281424B2

(12) United States Patent
Okubo et al.

(10) Patent No.: US 8,281,424 B2
(45) Date of Patent: Oct. 9, 2012

(54) FLUSH TOILET

(75) Inventors: Mayu Okubo, Fukuoka (JP); Yoshikazu Ushijima, Fukuoka (JP); Yuichi Sato, Fukuoka (JP); Yoshinobu Kato, Fukuoka (JP); Ryosuke Hayashi, Fukuoka (JP)

(73) Assignee: Toto Ltd., Fukuoka (JP)

( * ) Notice: Subject to any disclaimer, the term of this patent is extended or adjusted under 35 U.S.C. 154(b) by 201 days.

(21) Appl. No.: 12/441,559

(22) PCT Filed: Jun. 27, 2008

(86) PCT No.: PCT/JP2008/061746

§ 371 (c)(1),
(2), (4) Date: Aug. 13, 2009

(87) PCT Pub. No.: WO2009/001932

PCT Pub. Date: Dec. 31, 2008

(65) Prior Publication Data

US 2010/0132105 A1 Jun. 3, 2010

(30) Foreign Application Priority Data

Jun. 28, 2007 (JP) ..... 2007-170795

(51) Int. Cl.
*E03D 11/00* (2006.01)

(52) U.S. Cl. ..... 4/431; 4/354; 4/334; 4/332

(58) Field of Classification Search ..... 4/431–433, 4/331–332, 334, 362, 373, 368, 421
See application file for complete search history.

(56) References Cited

U.S. PATENT DOCUMENTS

| | | | | |
|---|---|---|---|---|
| 5,305,475 | A | 4/1994 | Jaeckels et al. | |
| 5,542,132 | A | 8/1996 | Jaeckels et al. | |
| 5,608,923 | A | 3/1997 | Jaeckels et al. | |
| 5,729,837 | A | 3/1998 | Jaeckels et al. | |
| 5,867,844 | A | 2/1999 | Jaeckels et al. | |
| 5,913,611 | A | 6/1999 | Jaeckels et al. | |
| 6,986,172 | B2 * | 1/2006 | Hidetaka et al. | 4/425 |
| 2006/0096017 | A1 * | 5/2006 | Yamasaki et al. | 4/420 |
| 2007/0113331 | A1 * | 5/2007 | Prokopenko et al. | 4/425 |

FOREIGN PATENT DOCUMENTS

| | | |
|---|---|---|
| JP | 2005-264469 | 9/2005 |
| JP | 2006-104669 A | 4/2006 |
| JP | 2006-177051 | 7/2006 |
| JP | 2006-257870 | 9/2006 |
| JP | 2007-138432 | 6/2007 |

* cited by examiner

*Primary Examiner* — Gregory Huson
*Assistant Examiner* — Erin Deery
(74) *Attorney, Agent, or Firm* — Brooks Kushman P.C.

(57) ABSTRACT

A flush toilet for prevention of reverse flow and uses a reduced number of parts. The flush toilet includes a toilet body having a bowl, a rim water outlet, a jet water outlet, and a discharge water trap piping; a water storage tank. A flush water supply mechanism is provided for supplying flush water to the rim water outlet and the water storage tank and a pressurizing pump pressurizes the flush water in the water storage tank. A jet-side water supply path supplies the pressurized flush water to the jet water outlet. An overflow path is provided having a lower end connected to the downstream side of the highest position of the jet-side water supply path and an upper end opened in the upper part in the water storage tank with a flapper valve provided in the overflow path.

4 Claims, 5 Drawing Sheets

FLUSH TOILET

TECHNICAL FIELD

The present invention relates to a flush toilet, and more particularly to a flush toilet cleaned by pressurized flush water.

BACKGROUND ART

Conventionally flush toilets have been known in which, as shown in Patent Document 1 for example, a reservoir tank is provided, and cleaning is accomplished by pressurizing flush water in the reservoir tank using a pressurizing pump and supplying this pressurized water to a toilet main unit.

The flush toilet set forth in this Patent Document 1 is one in which the toilet is cleaned by supplying flush water from a water main source to a rim water path and to a reservoir tank, pressurizing the flush water in the reservoir tank using a pressurizing pump, and supplying a jet-hole.

In addition, a check valve and an atmosphere release valve are provided on the guide path for supplying flush water to the jet-hole in this flush toilet; backflow of flush water from the toilet main unit to the reservoir tank is prevented by this check valve, and air remaining in the water guide path is discharged using an atmosphere released valve, thereby partitioning the toilet main unit and the reservoir tank.

Furthermore, an overflow pipe for conducting flush water overflowing from the reservoir tank is provided on the rim water path in this toilet, and a negative pressure breaker valve is provided on this overflow pipe.

Patent Document: JP-A-2005-264469

In the flush toilet according to Patent Document 1, backflow of flush water from the toilet main unit to the reservoir tank is prevented, and flush water overflowing from the reservoir tank can be discharged externally, but this requires the provision of a check valve, an atmosphere release valve, a negative pressure breaker valve, and the like, leading to a complex structure, an increased number of parts, and other problems. For this reason, further improvements to the flush toilet shown in Patent Document 1 have been desired.

DISCLOSURE OF THE INVENTION

The present invention was thus undertaken to resolve the above-described problems, and has the object of providing a flush toilet capable of preventing backflow from the toilet main unit to the reservoir tank, and of externally discharging flush water overflowing from the reservoir tank with a simplified structure and a reduced number of parts.

In order to resolve the above-described problem, the present invention is a flush toilet cleaned by pressurized flush water, the flush toilet comprising a toilet main unit provided with a bowl portion, a rim water spouting port and a jet water spouting port both for expelling flush water, and a drain trap pipe; a reservoir tank for storing flush water; flush water supply means for supplying flush water to the rim water spouting port and replenishing the reservoir tank; a pressurizing pump for pressurizing flush water in the reservoir tank; a jet-side water supply path, formed in a convex shape pointing upward, for supplying flush water pressurized by the pressurizing pump to the jet water spouting port; an overflow path, the lower end of which is connected downstream of the highest position of the jet-side water supply, and the upper end of which opens in the upper side of the reservoir tank; and backflow prevention means, provided on the overflow path, for preventing backflow of flush water from the jet-side water supply path to the reservoir tank; wherein a highest position L1 of the jet-side water supply path is set to be equal to or higher than the position of a highest water level L3 in the reservoir tank during a normal operation; an upper end position L2 of the overflow path is set to be equal to or higher than the position of the highest water level L3 in the reservoir tank; the upper end position L2 of the overflow path is set to be higher than the position of a lower end L6 of the overflow path and the position of an accumulated water level L7 in the bowl; and the position of a lower end L6 of the overflow path is set to be equal to or higher than the position of the accumulated water level L7 in the bowl.

In the present invention thus constituted, the jet-side water supply path highest position L1 is first set to be at the equal or higher position as the highest water level L3 in the reservoir tank during the normal operation; therefore when water is supplied to the reservoir tank, flush water stored inside the reservoir tank is not supplied to the bowl portion via the jet-side water supply path, and the highest reservoir tank water level L3 can thus be obtained when supplying water to the tank. Next, the overflow path upper end position L2 is set to be equal to or higher than the position of the reservoir tank highest water level L3; the overflow path upper end position L2 is set to be higher than the overflow path lower end position L6 and the bowl portion accumulated water level L7, and the overflow path lower end position L6 is set to be equal or higher position as the bowl portion accumulated water level L7; therefore when the volume of flush water in the reservoir tank increases and the water level in the tank exceeds the highest water level L3, flush water is discharged from the overflow path to the jet-side water supply path, but at this point, because the overflow path upper end position L2 to set to be higher than the lower position L6 thereof, flush water is able to flow smoothly within the overflow path, and because the overflow path lower end position L6 is set to be equal to or higher than the position of the bowl portion accumulated water level L7, air is supplied from the overflow path upper end position L2 to the jet-side water supply path to accomplish a partition. Also, air accumulated in the jet-side water supply path when the pressurizing pump turns ON can be discharged through the overflow path into the reservoir tank, reducing the air discharged from the jet water spouting port, and reducing the sound generated by the discharge of air at the jet water spouting port.

In the present invention, the highest position L1 of the jet-side water supply path and the upper end position L2 of the overflow path are preferably set to be higher than an overflow edge position L5 of the toilet main unit.

In the present invention thus constituted, the jet-side water supply path highest position L1 and the overflow path upper end position L2 are set to be higher than the toilet main unit overflow edge position L5, therefore even if by some chance the drain trap pipe became blocked, backflow into the reservoir tank of dirty water in the bowl portion could be prevented.

In the present invention, the pressurizing pump is preferably a non-self priming pump, and the highest water level L3 in the reservoir tank during the normal operation is set to be higher than an upper end position L4 of a pump chamber of the pressurizing pump.

In the present invention thus constituted, the highest water level L3 in the reservoir tank during the normal operation is set to be at a higher position than the pressurizing pump chamber upper end position L4 when the pressurizing pump is a non-self priming pump, therefore the air cavitation which occurs in non-self priming pumps due to air remaining in the pump chamber can be prevented.

In the present invention, the reservoir tank is preferably an open-type reservoir tank open to the atmosphere at the upper side thereof, and an overflow edge position L0 of the open type reservoir tank is set to be higher than the overflow edge position L5 of the toilet main unit.

In the present invention thus constituted, for cases in which the reservoir tank is an open-type reservoir tank, the overflow edge position L0 of this open type reservoir tank is set to be higher than the position L5 of the overflow edge on the toilet main unit, therefore even if for some reason such as a breakage or a blockage of the drain trap type, flush water exceeding the capacity of the overflow path flowed into the reservoir tank and the water level therein rose, the flush water would leak away from the toilet main unit overflow edge, which would cause the user to notice the anomaly in the toilet and take appropriate action.

The flush toilet of the present invention enables the prevention of backflow from the toilet main unit to the reservoir tank, and provides for a simplification of structures for externally draining flush water overflowing from the reservoir tank and an accompanying reduction in the number of parts required.

BEST MODE FOR CARRYING OUT THE INVENTION

Next, referring to be attached drawings, a flush toilet according to an embodiment of the present invention will be described.

First, referring to FIGS. 1 through 4, the structure of a flush toilet according to an embodiment of the present invention will be described. Here, FIG. 1 is a side elevation of a flush toilet according to an embodiment of the present invention; FIG. 2 is a plan view of the flush toilet shown in FIG. 1; FIG. 3 is an schematic overview showing a flush toilet according to an embodiment of the present invention; and FIG. 4 is a schematic cross-sectional view showing a flapper valve and surrounding area thereof used in a flush toilet according to an embodiment of the present invention.

As shown in FIG. 1 and FIG. 2, a flush toilet 1 according to an embodiment of the present invention comprises a flush toilet main unit 2, a toilet seat 4 disposed on the upper surface of the toilet main unit 2, a cover 6 disposed so as to cover the toilet seat 4, and an outer flushing device 8 disposed at the rear and above the toilet main unit 2. In addition, a functional portion 10 is disposed at the rear of the toilet main unit 2, and the functional portion 10 is covered by side panels 11.

Formed on the toilet main unit 2 are a bowl portion 12 for receiving waste, a drain trap pipe 14 extending from the lower portion of the bowl portion 12, a jet water spouting port 16 for jet water spouting, and a rim water spouting port 18 for rim water spouting.

The jet water spouting port 16 is formed at the bottom of the bowl portion 12, configured to expel flush water toward the inlet to the drain trap pipe 14, and disposed approximately horizontally, pointing toward the inlet of the drain trap pipe 14 so as to expel flush water toward the drain trap pipe 14.

The rim water spouting port 18 is formed at the left side upper rear of the bowl portion 12, and expels flush water along the edge of the bowl portion 12.

The drain trap pipe 14 comprises an inlet portion 14*a*, a trap ascending pipe 14*b* rising from the inlet portion 14*a*, and a trap descending pipe 14*c* dropping from the trap ascending pipe connecting port 14*b*; between the trap ascending pipe 14*b* and the trap descending pipe 14*c* is a peak portion 14*d*.

The flush toilet 1 is directly connected to a water main supplying flush water; flush water is expelled from a rim water spouting port 18 under water main supply pressure. As discussed below, jet water spouting is accomplished by expelling from a jet water spouting port 16 a large volume of flush water stored in a reservoir tank 20 built into a functional portion 10 and pressurized by a pressurizing pump 22.

Next, referring to FIG. 3, the functional portion 10 according to a first embodiment will be described in detail.

As shown in FIG. 3, a water supply path 24 with which flush water is supplied from a water main is provided on the functional portion 10; from the upstream direction, a stopcock 26, a strainer 28, a splitter hardware 30, a constant volume valve 32, a diaphragm-type electromagnetic on/off valve 34, and a water supply path switching valve 36 are provided on this water supply path 24.

This constant volume valve 32, diaphragm-type electromagnetic on/off valve 34, and water supply path switching valve 36 are integrally assembled as a single unit 37, as shown in FIG. 3.

In addition, a rim-side water supply path 38 for supplying flush water to the rim water spouting port 18, and a tank-side water supply path 40 for supplying flush water to the reservoir tank 20, are connected to the downstream side of the water supply path switching valve 36.

Here, the purpose of the constant volume valve 32 is to restrict flush water flowing through the strainer 28 and the splitter hardware 30 down to a predetermined flow volume or less. Flush water which has passed through the constant volume valve 32 flows into the electromagnetic on/off valve 34, and flush water which as passed through the electromagnetic on/off valve 34 is supplied from the rim-side water supply path 38 on the rim side to the rim water spouting port 18 by the water supply path switching valve 36, or from the tank-side water supply path 40 on the tank side to the reservoir tank 20. Here the water supply path switching valve 36 can supply flush water to both the rim-side water supply path 38 and the tank-side water supply path 40 at the same timing, allowing for optionally changing the proportion of respectively supplied water volumes to the rim side and the tank side.

A pump-side water supply path 45 is connected to the bottom portion of the reservoir tank 20, and a pressurizing pump 22 furnished with a pump chamber 22*a* is connected to the downstream end of this pump-side water supply path 45. In addition, the pressurizing pump 22 and the jet water spouting port 16 are connected by the jet-side water supply path 46, and the pressurizing pump 22 pressurizes flush water held in the reservoir tank 20 and supplies it to the jet water spouting port 16.

The jet-side water supply path 46 is formed in an upward pointing convex shape as shown in FIG. 3, and the peak portion 46*a* of this convexly shaped part is at the highest position (the highest position L1 of the jet-side water supply path).

Next, a rim water spouting vacuum breaker 48 is provided on the above-described rim-side water supply path 38, preventing backflow from the rim water spouting port 18 when negative pressure occurs on the water supply path 24. Also, as shown in FIG. 3, the rim water spouting vacuum breaker 48 is disposed above the upper end surface of the bowl portion 12, thereby reliably preventing backflow. Moreover, flush water overflowing from the atmosphere release portion of the rim water spouting vacuum breaker 48 flows into the reservoir tank 20 via a return pipe 50.

A vacuum breaker 42 serving as a check valve is also provided on the tank-side water supply path 40, thereby preventing backflow from the reservoir tank 20.

Here, the reservoir tank 20 is a sealed reservoir tank, and a ball-type check valve 43 is provided on a connecting portion between the tank-side water supply path 40 and the reservoir tank 20. Because of this ball-type check valve 43, even if the reservoir tank 20 in a full state exceeds the position of the upper end 70*a* of the overflow path 70 described below, the ball 43*a* floats, and the portion connecting to the tank-side water supply path 40 is closed, therefore flush water will not flow back into the tank-side water supply path 40.

Similarly, a ball-type check valve 44 is provided on the connecting portion with the return pipe 50, so that even if the reservoir tank 20 exceeds the position of the upper end 70*a* of the overflow path 70 described below, there is no backflow to the return pipe 50.

Furthermore, a jet water spouting flapper valve 56 serving as a check valve, and a drain plug 58 are provided on the pump-side water supply path 45. This jet water spouting flapper valve 56 and drain plug 58 are disposed at a height near the bottom end portion of the reservoir tank 20, below the pressurizing pump 22. Therefore flush water in the reservoir tank 20 and in the pressurizing pump 22 can be drained for maintenance and the like by opening the drain plug 58. Also by disposing the jet water spouting flapper valve 56 between the reservoir tank 20 and the pressurizing pump 22, flush water will flow back from the pressurizing pump 22 to the reservoir tank 20 when the water level in the reservoir tank 20 falls below the height of the pressurizing pump 22, therefore freewheeling of the pressurizing pump 22 if the pressurizing pump 22 is emptied of flush water can be prevented. A water receiving tray 60 is also disposed beneath the pressurizing pump 22 to receive condensed water droplets or leaks.

A controller 62 for controlling the operation of the electromagnetic on/off valve 34, the operation of the water supply path switching valve 36, and the rpm, operating time, and the like of the pressurizing pump 22 is built into the functional portion 10.

An upper end float switch 64*a* and a lower end float switch 64*b* are disposed inside the reservoir tank 20.

The upper end float switch 64*a* switches to ON when the water level inside the reservoir tank 20 reaches a predetermined level L10 slightly below the highest water level L3 under normal use; the controller 62 senses this and closes the electromagnetic on/off valve 34.

The lower end float switch 64*b* switches to ON when the water level inside the reservoir tank 20 reaches a predetermined level L12 slightly below the lowest water level L11 under normal use; the controller 62 senses this and stops the pressurizing pump 22.

An overflow path 70 is further provided; the upper end 70*a* of this overflow path 70 opens into the reservoir tank 20; the lower end 70*b* thereof is connected on the downstream side of (on the jet water spouting port 16 side of) the highest position L11 of the jet-side water supply path 46.

A flapper valve 72 serving as a check valve is attached to the overflow path 70. The overflow path 70 and the flapper valve 72 prevent backflow of flush water from the jet water spouting port 16 and enable those parts to be partitioned.

To explain the flapper valve 72 more specifically, the flapper valve 72 has a valve body 72*a*, and the valve body 72*a* is rotatable around a valve body axis 72*b* provided on the upper end thereof, as shown in FIG. 4. Also, the flow path of the overflow path 70 can be opened and closed between the upper end 70*a* and the lower end 70*b* of the flapper valve 72.

The flapper valve 72 valve body 72*a* is in the open position shown by the solid line when the pressurizing pump 22 is in the normal non-driven state; in this position air in the reservoir tank 20 can be supplied to the jet-side water supply path 46. Also, immediately after the pressurizing pump 22 has started, the valve body 72*a* is in the open position shown by the solid line, therefore air remaining in the jet-side water supply path 46 can be exhausted through the overflow path 70 into the reservoir tank 20 shown by the arrow A. In the open position, when the water level in the reservoir tank 20 exceeds the overflow path 70 upper end 70*a*, flush water which overflowing inside the reservoir tank 20 passes through the overflow path 70 and is discharged into the jet-side water supply path 46 as shown by the arrow B.

At the same time, after the pressurizing pump 22 starts and air remaining in the jet-side water supply path 46 is discharged to the reservoir tank 20 side, the flapper valve 72 valve body 72*a* goes to the closed position, as shown by the dotted line, under pressure of the flush water when the flush water in the reservoir tank 20 is pressurized by the pressurizing pump 22 and supplied to the jet water spouting port 16, such that flush water flowing in the jet-side water supply path 46 does not backflow to the overflow path 70.

The controller 62, in response to operation of a toilet flushing switch (not shown) by a user, sequentially operates the electromagnetic on/off valve 34, the water supply path switching valve 36, and the pressurizing pump 22, first spouting water from the rim water spouting port 18; while continuing to spout rim water, it next commences spouting water from the jet water spouting port 16 to flush the bowl portion 12. Furthermore, the controller 62 opens the electromagnetic on/off valve 34 after flushing is completed, switching the water supply path switching valve 36 over to the reservoir tank 20 side to replenish flush water to the reservoir tank 20. When the water level inside the reservoir tank 20 rises, and the upper end float switch 64*a* detects a predetermined water volume, the controller 65 closes the electromagnetic on/off valve 34 and stops the supply of water.

Next, referring to FIG. 5, the flushing operation in a flush toilet according to the present embodiment will be described. FIG. 5 is a timing chart showing the flush operation in a flush toilet according to an embodiment of the present invention.

As shown in FIG. 5, in the standby state (time t0-t1) the water supply path switching valve 36 is in a neutral position communicating with both the rim-side water supply path 38 and the tank-side water supply path 40. Next, when a toilet flushing switch (not shown) is operated (time t1) during this standby state (time t0-t1), former front rim water spouting is commenced (time t1-t11). At this point the water supply path switching valve 36 is placed in a state whereby it is fully open to the tank-side water supply line 40 during the interval between times t2-t3 (the tank side fully open position). Simultaneously (time t2), the electromagnetic on/off valve 34 is turned ON and flush water is caused to flow into the water supply path 24. This enables air remaining within the water supply path 24 on the upstream side of the water supply path switching valve 36 to be discharged into the reservoir tank 20. As a result, the air discharge sound from the rim water spouting port 18 arising when the water supply path switching valve 36 is suddenly switched to the rim-side water supply path 38, which is the rim side, can be prevented.

Next, between times t3-t4, the water supply path switching valve 36 is switched from the tank-side fully open position to the rim-side fully open position, flush water is supplied to the rim water spouting port 18, and flush water is spouted from the rim water spouting port 18.

Next, after a predetermined time has elapsed from time t2 (e.g. 5 seconds), jet water is spouted in the interval between times t5-t11 by turning ON the pressurizing pump 22 and using the pressurizing pump 22 to supply flush water in the reservoir tank 20 to the jet water spouting port 16, thereby spouting flush water from the jet water spouting port 16.

Next, the controller 62 controls the rpm of the pressurizing pump 22 while this jet spouting is going on as follows.

First, at time t6-t7, the pressurizing pump 22 is kept at a relatively slow speed (e.g., 1000 rpm), by which means air remaining in the vicinity of the jet-side water supply path 46 peak portion 46*a* (i.e., the portion positioned above the accumulated water surface of the bowl portion 12) is discharged from the jet water spouting port 16. As a result, the sound of air being discharged from the jet water spouting port 16, which is generated when the pressurizing pump 22 is suddenly started at its originally intended high rotation speed, can be prevented.

Next, at time t8-t9, the pressurizing pump 22 is rotated at a high speed (e.g., 3500 rpm). This causes the pressurizing force of the pressurizing pump 22 to increase, so that a large flow volume of flush water is spouted from the jet water spouting port 16. At this point, rim water is being continuously spouted from the rim water spouting port 18, therefore the flow volume of flush water spouted from the rim water spouting port 18 is added thereto, and a large flow volume of flush water flows into the drain trap pipe 14 inlet portion 14*a*, such that a siphon effect is rapidly induced, and accumulated water and waste in the bowl portion 12 is quickly discharged. At this point the flow volume flowing into the drain trap pipe 14 inlet portion 14*a* (the first flow volume) is between 75 liters/minute-120 liters/minute as the total flow volume coming from rim water spouting and from jet water spouting, which is a large flow volume compared to conventional examples.

Next, at time t9-t11, the flow volume of flush water flowing into the drain trap pipe 14 inlet portion 14*a* (the second flow volume) is set to be a smaller flow volume than the flow volume described above (the first flow volume), therefore the pressurizing pump 22 rpm is slightly decreased. In this FIG. 5 example, the rpm of the pressurizing pump 22 is reduced in two stages (e.g., 3300 rpm and 3200 rpm) in order to cause the second flow volume to flow into the drain trap pipe 14 inlet portion 14*a*. At this point the pressurizing pump 22 rpm may have just one stage, without variation, or may be reduced in three or more stages.

Thus a second flow volume of flush water, smaller than the first flow volume, is caused to flow into the drain trap pipe 14 inlet portion 14*a* immediately before the siphon effect generated by the first flow volume ends (time t9).

Next, at time t11, operation of the pressurizing pump 22 is stopped when the flush water level in the reservoir tank 20 drops and the lower end float switch 64*b* turns ON. At this point the pressurizing pump 22 rpm is slowly decreased between time t11-t12 so that spouting of water from the jet water spouting port 16 gradually decreases. This enables the prevention of a siphon cutoff sound arising from a sudden interruption in the siphon action.

Next, at time t11, jet water spouting has ended, but at this point rim water spouting continues as it was, and during a predetermined period from time t11 to time t13 (e.g. 4 seconds), only rim water spouting (latter rim water spouting) is continued.

Subsequently, at time t13-t14, the water supply path switching valve 36 switches from the rim-side fully open to tank-side fully open position. Flush water is thus accumulated in the reservoir tank 32.

Next, at time t15, the upper end float switch 32*b* turns ON due to the rise in water level in the reservoir tank 20, which turns OFF the electromagnetic on/off valve 34 (a closing operation) such that the inflow of flush water to the reservoir tank 20 is stopped.

Next, at time t16, the water supply path switching valve 36 returns to the neutral position at which it communicates with both the rim side and the tank side, and is restored to the standby state (the same state as at time t0).

Next, returning to FIG. 3, we discuss the relationships in the height direction between major parts of the flush toilet according to the present embodiment.

Assuming the highest position in the jet-side water supply path 46 is L1, the upper end position of the overflow path 70 (the position of the upper end 70*a*) is L2, the highest water level in normal use within the reservoir tank 20 is L3, the upper end position of the pressurizing pump 22 pump chamber 22*a* is L4, the position of the toilet main unit 2 overflow edge is L5, the lower end position of the overflow path 70 (the position of the lower end 70*b*) is L6, and the level of accumulated water in bowl portion 12 is L7, the following positional relationships are established for the flush toilet of the present embodiment.

First, the highest position L1 in the jet-side water supply path 46 is set to be equal to or higher than the position of the highest water level L3 inside the reservoir tank during the normal operation. By setting L1 and L3 in this way, flush water stored in the reservoir tank 20 will not pass through the pump-side water supply path 45 and the jet-side water supply path 46 to be supplied to the bowl portion 12 when water is supplied to the reservoir tank 20, therefore the highest level L3 in the reservoir tank 20 can be achieved.

Next, the upper end position L2 of the overflow path 70 is set to be equal to or higher than the reservoir tank 20 highest water level L3, and the overflow path 70 upper end position L2 is set to be higher than the overflow path lower end position L6 and the accumulated water level L7 in the bowl portion. At this point the overflow path 70 lower end position L6 is set to be equal to or higher than the accumulated water level L7 in the bowl portion 12.

Setting L2, L3, L6, and L7 to have this positional relationship enables correct functioning of the overflow of flush water in the reservoir tank 20, and permits air to be supplied to the jet-side water supply path 46 for reliable partitioning between the reservoir tank 20 and the jet water spouting port 16 so as to stabilize the highest water level L3 in the reservoir tank 20, thereby promoting the discharge toward the reservoir tank 20 side of air accumulated in the jet-side water supply path 46. That is, when the flush water volume increases in the reservoir tank 20 and the water level in the tank exceeds the highest level L3, flush water is discharged from the overflow path 70 to the jet-side water supply path 46. At this point, the upper end position L2 of the overflow path 70 is set at a higher position than the lower end position L6, therefore flush water is able to flow smoothly in the overflow path 70. Furthermore, because the lower end L6 of the overflow path 70 is set to be equal to or higher than the accumulated water level L7 in the bowl portion 12, flush water in the jet-side water supply path 46 is smoothly discharged into the bowl portion 12. When the water level in the reservoir tank 20 drops after the pressurizing pump 22 is driven, air is supplied from the overflow path 70 upper end position L2 through the lower end L6 to the jet-side water supply path 46, and a partition between the reservoir tank 20 and the jet water spouting port 16 can thus be accomplished. Note also that air accumulated in the jet-side water supply path 46 at the time of the next pressurizing pump operation is discharged into the reservoir tank 20 via the overflow path 70, as a result of which less air is discharged from the jet water spouting port 16, thus reducing the noise accompanying the air discharge at the jet water spouting port 16.

Moreover, the jet-side water supply path 46 highest position L1 and the overflow path 70 upper end position L2 are set to be higher than the position L5 of the overflow edge on the toilet main unit 2, therefore even if by some chance the drain trap pipe became blocked, backflow into the reservoir tank 20 of dirty water in the bowl portion could be prevented.

Note that the jet-side water supply path 46 highest position L1 and the overflow path 70 upper end position L2 are higher than the accumulated water level L7 in the bowl portion 12, therefore in normal use backflow from the bowl portion 12 to the reservoir tank 20 is prevented.

In addition, when the pressurizing pump 22 is not a self-priming pump, the highest water level L3 in the reservoir tank 20 under normal use is set to be higher than the upper end position L4 of the pressurizing pump 22 pump chamber 22*a*, therefore the pressurizing pump 22 pump chamber 22*a* is filled with flush water, and air cavitation, which occurs in non-self priming pumps due to air remaining in the pump chamber 22*a*, can be prevented.

Next, referring to FIG. 6, a flush toilet according to another embodiment of the present invention will be described. FIG. 6 is an schematic overview showing a flush toilet according to another embodiment of the present invention.

As shown in FIG. 6, a reservoir tank 80 is an open-type reservoir tank in which the upper end 80*a* is left open. Flush water to this reservoir tank 80 is supplied by a tank-side water supply path 42, and return flush water thereto is also supplied by a return pipe 50.

In another flush toilet embodiment, the ball-type check valves 43 and 44 in the embodiments described above are not provided.

Here, the overflow edge position L0 of the open-type reservoir tank 80 is set to be higher than the overflow edge position L5 of the toilet main unit 2. As a result, in this flush toilet according to another embodiment, if flush water were ever to exceed the capacity of the overflow path 70 in the reservoir tank 80 and flow inward due to a breakage of blockage of the drain trap pipe 14 or the like, such that the water level rose, that flush water would leak away from the toilet main unit 2 overflow edge. As a result, the user would note the anomaly in the toilet and could take some action. This is because the user would not notice a leakage of water, since the reservoir tank 80 is covered by said panels 11.

EXPLANATION OF REFERENCE NUMERALS

Figure 1:
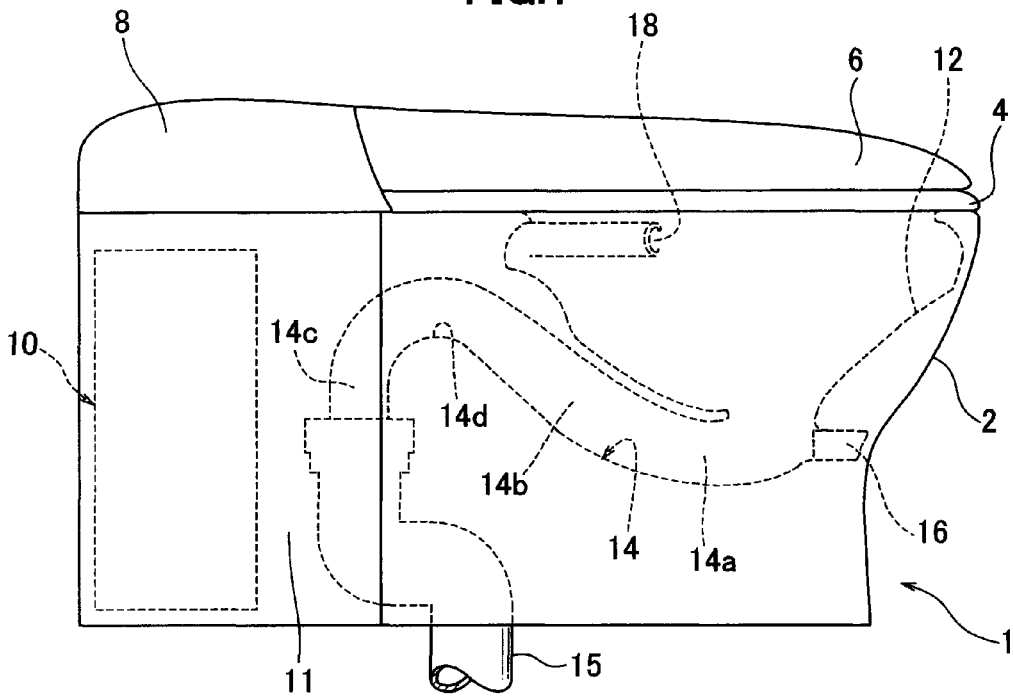
FIG. 1 is a side elevation showing a flush toilet according to an embodiment of the present invention.
Figure 2:
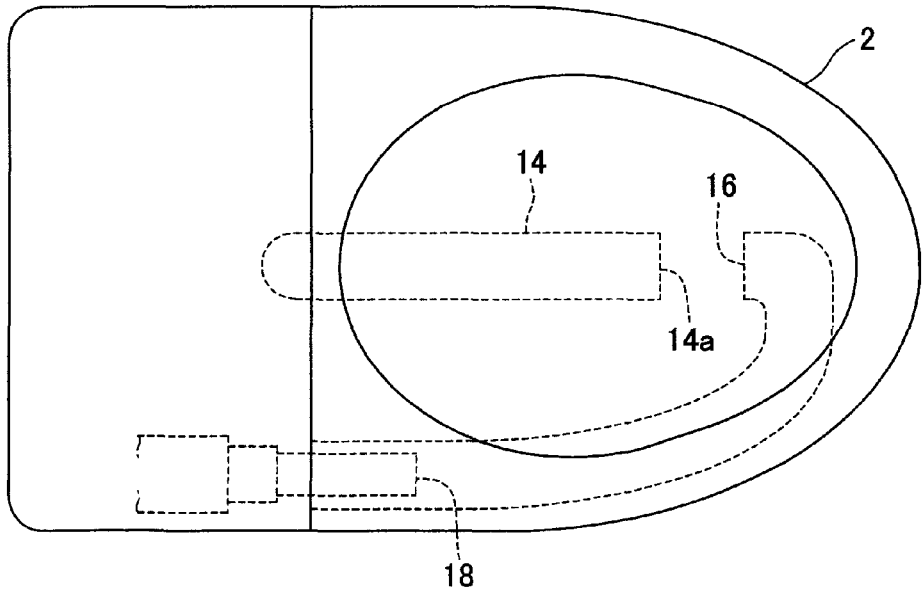
FIG. 2 is a plan view of the flush toilet shown in FIG. 1.
Figure 3:
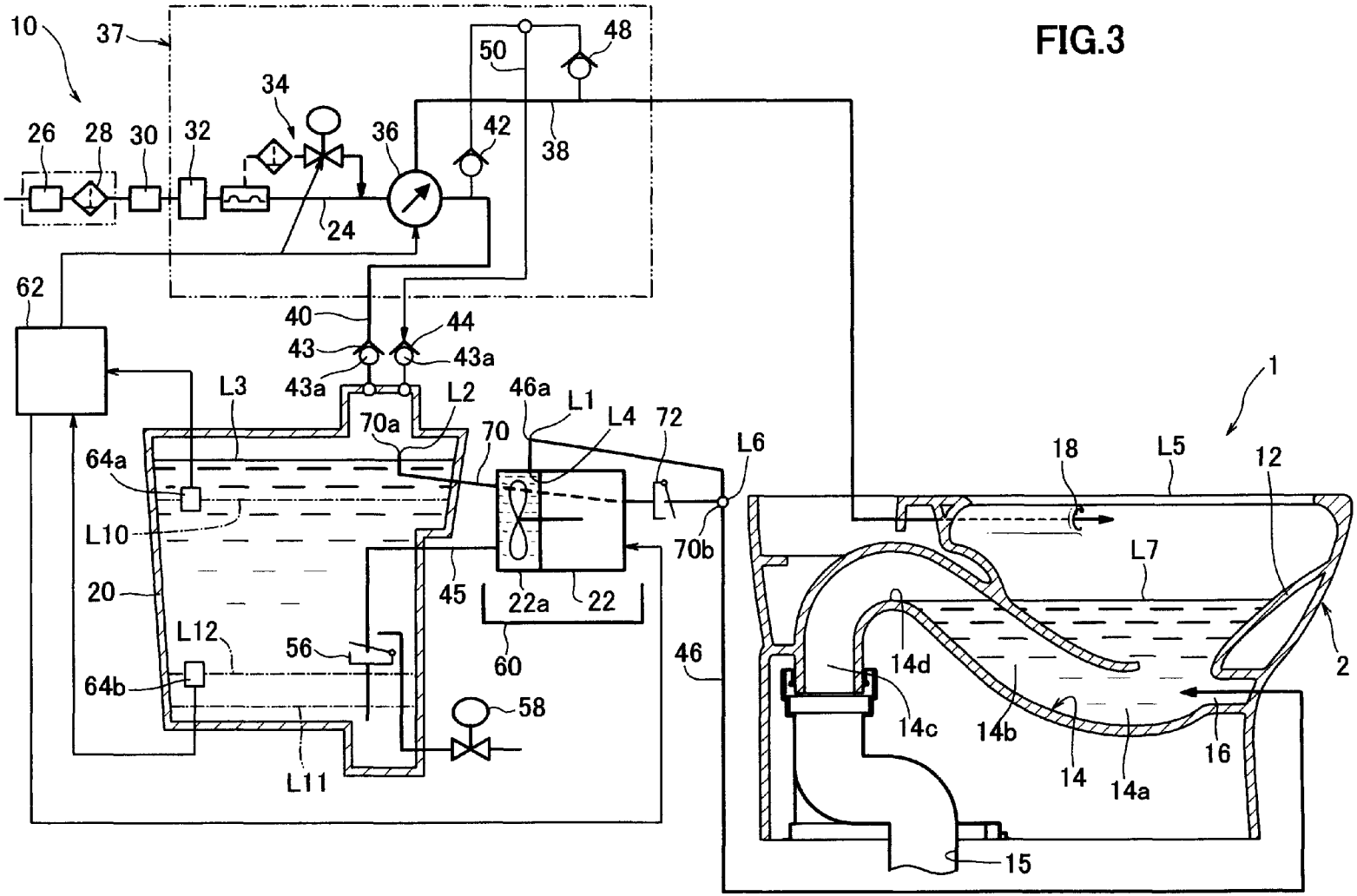
FIG. 3 is an overview schematic view showing the flush toilet according to the embodiment of the present invention.
Figure 4:
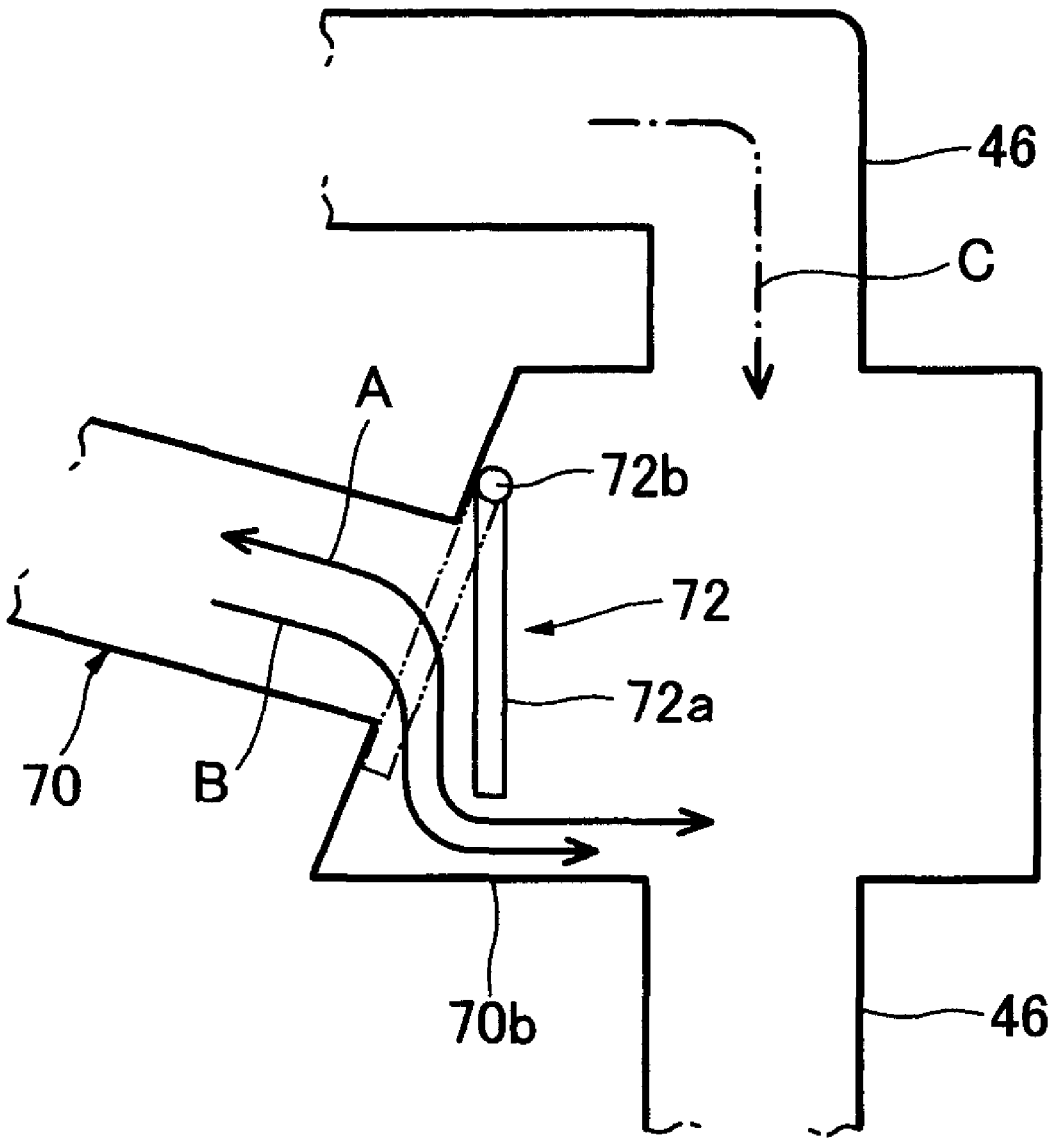
FIG. 4 is a schematic cross-sectional view showing a flapper valve and surrounding area thereof used in a flush toilet according to the embodiment of the present invention.
Figure 5:
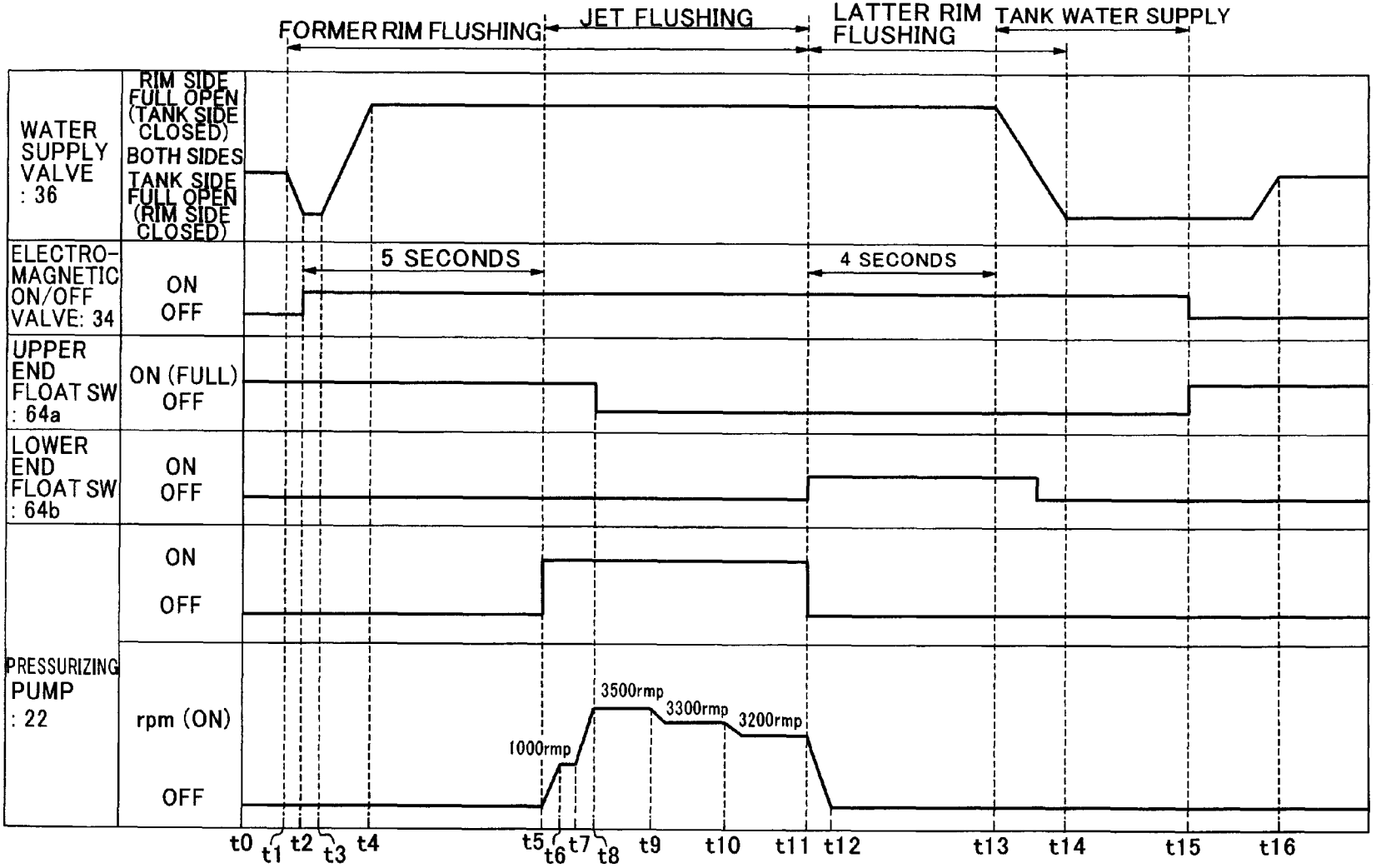
FIG. 5 is a timing chart showing the flush operation in the flush toilet according to the embodiment of the present invention.
Figure 6:
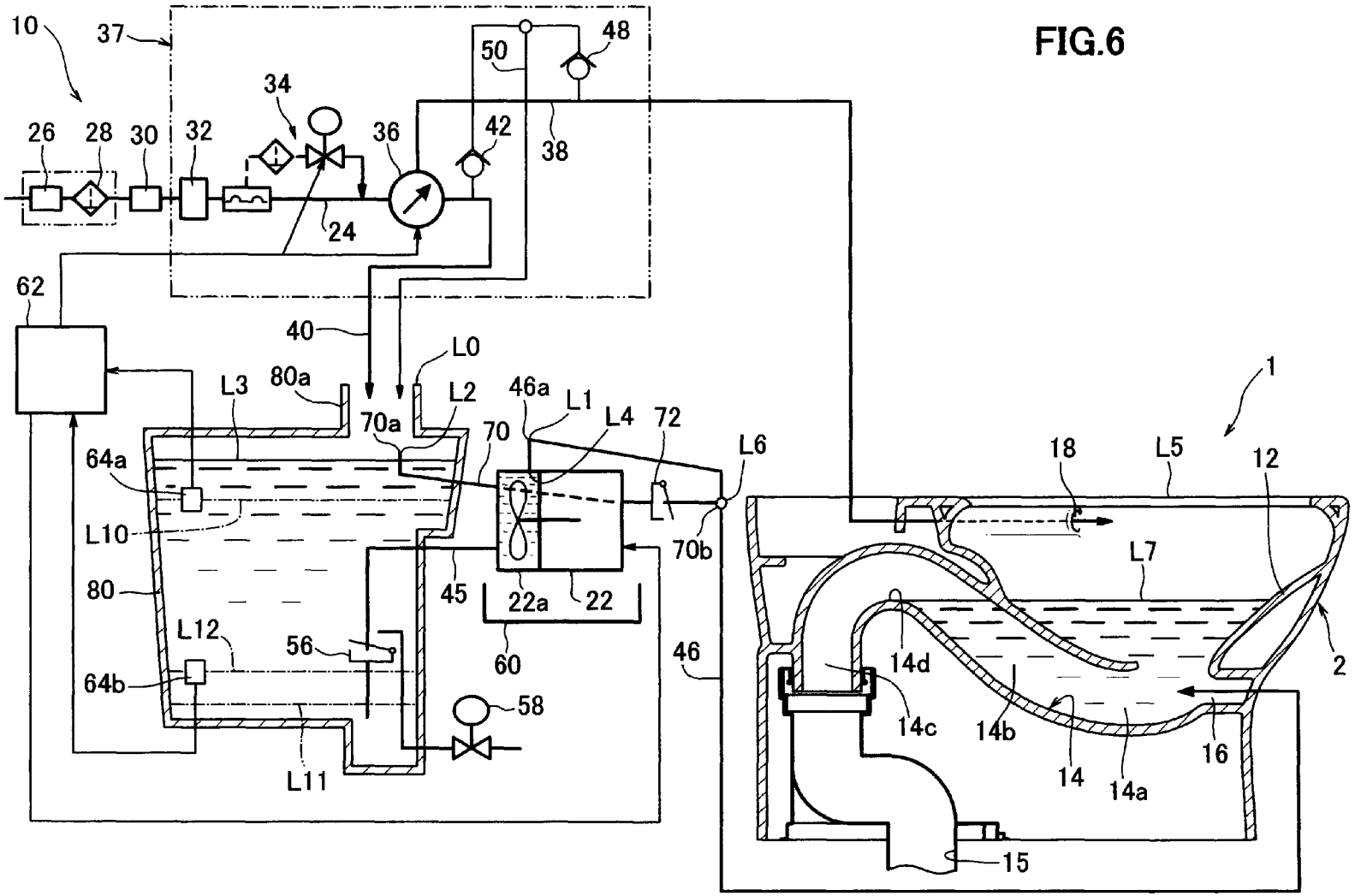
FIG. 6 is an overview schematic view showing a flush toilet according to another embodiment of the present invention.

1 flush toilet
2 flush toilet main unit
10 functional portion
12 bowl portion
14 train trap pipe
16 jet water spouting port
18 rim water spouting port
20,80 reservoir tank
22 pressurizing pump
24 water supply path
32 constant volume valve
34 electromagnetic on/off valve
36 water supply path switching valve
38 rim-side water supply path
40 tank-side water supply path
43,44 ball-type check valve
45 pump-side water supply path
46 jet-side water supply path
62 controller
64*a* upper end float switch
64*b* lower end float switch
70 overflow path
72 flapper valve
L1 highest position in jet-side water supply path
L2 upper end position of overflow path
L3 highest water level in normal use within reservoir tank
L4 upper end position in pump chamber of pressurizing pump
L5 position of toilet main unit overflow edge
L6 lower end position of overflow path
L7 level of accumulated water in bowl portion

What is claimed is:

1. A flush toilet cleaned by pressurized flush water, said flush toilet comprising:

a toilet main unit provided with a bowl portion, a rim water spouting port and a jet water spouting port both for expelling flush water, and a drain trap pipe;

a reservoir tank for storing flush water;

flush water supply means for supplying flush water to the rim water spouting port to clean the bowl portion of the toilet main unit and for replenishing flush water to the reservoir tank;

a pressurizing pump for pressurizing flush water in the reservoir tank;

a jet-side water supply path, formed in a convex shape pointing upward, for supplying flush water pressurized by the pressurizing pump to the jet water spouting port to clean the bowl portion of the toilet main unit together with the flush water supplied from the rim water spouting port;

an overflow path, the lower end of which is connected downstream of the highest position of the jet-side water supply, and the upper end of which opens in the upper side of the reservoir tank; and backflow prevention means, provided on the overflow path, for preventing backflow of flush water from the jet-side water supply path to the reservoir tank;

wherein a highest position (L1) of the jet-side water supply path is set to be equal to or higher than the position of a highest water level (L3) in the reservoir tank during a normal operation;

an upper end position (L2) of the overflow path is set to be equal to or higher than the position of the highest water level (L3) in the reservoir tank;

the upper end position (L2) of the overflow path is set to be higher than the position of a lower end (L6) of the overflow path and the position of an accumulated water level (L7) in the bowl; and the position of a lower end (L6) of the overflow path is set to be equal to or higher than the position of the accumulated water level (L7) in the bowl.

2. The flush toilet according to claim 1, wherein the highest position (L1) of the jet-side water supply path and the upper end position (L2) of the overflow path are set to be higher than an overflow edge position (L5) of the toilet main unit.

3. The flush toilet according to claim 1, wherein the pressurizing pump is a non-self priming pump, and the highest water level (L3) in the reservoir tank during the normal operation is set to be higher than an upper end position (L4) of a pump chamber of the pressurizing pump.

4. The flush toilet according to claim 1, wherein the reservoir tank is an open-type reservoir tank open to the atmosphere at the upper side thereof, and an overflow edge position (L0) of the open type reservoir tank is set to be higher than the overflow edge position (L5) of the toilet main unit.

* * * * *